US005550621A

United States Patent [19]

Ogawahara

[11] Patent Number: 5,550,621

[45] Date of Patent: Aug. 27, 1996

[54] TONER IMAGE FUSING DEVICE WITH OPTIMIZED CONTROL OF COOLING A PRESSURE ROLLER

[75] Inventor: Norio Ogawahara, Saitama, Japan

[73] Assignee: Fuji Xerox Co., Ltd., Tokyo, Japan

[21] Appl. No.: 198,784

[22] Filed: Feb. 18, 1994

[30] Foreign Application Priority Data

Feb. 19, 1993 [JP] Japan ..... 5-030294

[51] Int. Cl.[6] ..... G03G 15/20

[52] U.S. Cl. ..... 355/285; 355/282

[58] Field of Search ..... 219/216; 355/282, 355/285, 289, 290, 208

[56] References Cited

U.S. PATENT DOCUMENTS

| | | | |
|---|---|---|---|
| 4,822,977 | 4/1989 | Leising et al. | 219/216 |
| 4,963,942 | 10/1990 | Aoki | 355/290 |
| 4,963,943 | 10/1990 | Tamary | 355/290 |
| 5,151,573 | 9/1992 | Masuda | 219/216 |
| 5,210,580 | 5/1993 | Aslam et al. | 355/290 |
| 5,212,528 | 5/1993 | Matsuda | 355/285 |
| 5,247,336 | 9/1993 | Mills, III | 355/285 |

FOREIGN PATENT DOCUMENTS

| | | |
|---|---|---|
| 48-74235 | 10/1973 | Japan . |
| 62-104264 | 7/1987 | Japan . |
| 2-136273 | 11/1990 | Japan . |

*Primary Examiner*—Sandra L. Brase

*Attorney, Agent, or Firm*—Finnegan, Henderson, Farabow, Garrett & Dunner, L.L.P.

[57] ABSTRACT

Four cooling fans 1 to 4 are provided under a pressure roller along its axial direction in a symmetric manner. The outside cooling fans 1 and 4 are disposed so as to face the non-paper-passing portions of the pressure roller when an A1 size transfer sheet is running with-its longer sides being parallel with the transport direction. The middle cooling fans 2 and 3 are disposed so as to face the non-paper-passing portions of the pressure roller when an A2 size transfer sheet is running with its longer sides being parallel with the transport direction. If the ambient temperature is high, all the cooling fans 1 to 4. are driven. If the ambient temperature is low, only the cooling fans 1 and 4 are driven when an A1-size sheet comes.

5 Claims, 3 Drawing Sheets

TONER IMAGE FUSING DEVICE WITH OPTIMIZED CONTROL OF COOLING A PRESSURE ROLLER

BACKGROUND OF THE INVENTION

1. Field of Invention

This invention relates to a fusing device for use with image forming apparatuses, such as copiers and printers, that employ the xerographic technology. More particularly, this invention relates to a toner image fusing device of the type in which a pressure roller or the like is cooled with fans or the like.

2. Description of Related Art

In most apparatuses, such as electrophotographic copiers and laser printers, that adopt the xerographic technology to produce recorded sheets, a toner image formed on the surface of a photoreceptor drum is transferred onto a transfer sheet, and the transfer sheet carrying the toner image is guided to a fusing device by means of a transport belt or the like. In the fusing device, the toner image is fused onto the transfer sheet to complete a recorded sheet.

This type of conventional toner image fusing device is most commonly of a heating roller type as taught in Japanese Utility Model Application Unexamined Publication No. Hei. 2-136273 ("Toner Image Fusing Device in Image Forming Apparatus"). In this heating roller type fusing device, a pressure roller having a metal pipe the surface of which is covered with an elastic member made of, for instance, silicone rubber is pressed against a heating roller having a built-in heater (heat generating lamp) at a specified pressure. And a transfer sheet is nipped between the two rollers so as to receive sufficient heat and pressure. Thus, a toner image is fused onto the transfer sheet.

In some cases of its operation, the fusing device must handle transfer sheets that varies in size over a broad range of, for instance, A0 to A3. The following problem occurs in such a case. When a long and narrow transfer sheet is nipped between the pressure and heating rollers, the portions of the pressure roller over which the transfer sheet does not pass (hereunder referred to as "non-sheet-passing portions") receive heat from the heating roller by the direct contact. As a result, the temperature of the non-paper-passing portions of the pressure roller becomes higher than that of the portion over which the transfer sheet passes (hereinafter referred to as "paper-passing portion"). If fusing of a toner image onto a smaller size transfer sheet is immediately followed by fusing onto a larger size transfer sheet, the above-described uneven temperature profile will cause wrinkles in the transfer sheet or a disorder of a fused image.

For example, Japanese Patent Application Unexamined Publication No. Sho. 48-74235 and Japanese Utility Model Application Unexamined Publication No. Sho. 62-104264 disclose methods for preventing the occurrence of wrinkles in a transfer sheet and other problems by cooling, while the transfer sheet is running, the pressure roller with cooling fans so that its temperature will not elevate unduly. However, this approach is not capable of fully efficient cooling when it is necessary to handle various sizes of transfer sheets coming in a mixed manner.

The occurrences of wrinkles in a transfer sheet and a disorder of a fused image are not limited to the case where fusing of a toner image onto a smaller size sheet is immediately followed by fusing onto a larger size sheet. But the same problems will also occur when the temperature of the environment in which the main body of a copier, a printer or the like is installed is high, or when a transfer sheet is fed from paper set on the machine which paper is in a high-temperature state. In particular, the problems such as wrinkles in a transfer sheet are more likely to occur when the cycle is repeated which consists of causing one transfer sheet to run, ejecting said sheet and, immediately thereafter, causing the next transfer sheet to run.

SUMMARY OF THE INVENTION

The present invention has been accomplished under the above circumstances, and has an object of providing a fusing device that is capable of efficient prevention of wrinkles in a transfer sheet and a disorder of a fused image even when the temperature of the environment in which a copier, a printer or the like is installed or the temperature paper as set in the machine is high.

Another object of the present invention is to provide a fusing device that is capable of efficient prevention of wrinkles of a transfer sheet or a disorder of a fused image even when it is necessary to handle transfer sheets of various sizes coming in a mixed manner.

According to the invention, a fusing device comprises:

fusing means for fusing a toner image onto a transfer sheet by applying heat thereto;

cooling means for cooling the fusing means;

temperature detecting means for detecting at least one of an ambient temperature and a temperature of a section in which transfer paper is set;

comparing means for comparing the temperature detected by the temperature detecting means with a predetermined temperature; and control means for controlling the cooling means in accordance with a comparison result of the comparing means.

According to another aspect of the invention, a fusing device comprises:

fusing means for fusing a toner image onto a transfer sheet by applying heat thereto;

cooling means having a plurality of cooling sections arranged in a direction perpendicular to a running direction of the transfer sheet, for cooling the fusing means; and control means for controlling said cooling means so that a cooling profile of the cooling means in a width direction of the transfer sheet is switched in accordance with a size of the transfer sheet.

DESCRIPTION OF THE PREFERRED EMBODIMENT

A preferred embodiment of the present invention will be described below with reference to the accompanying drawings.

Figure 1:
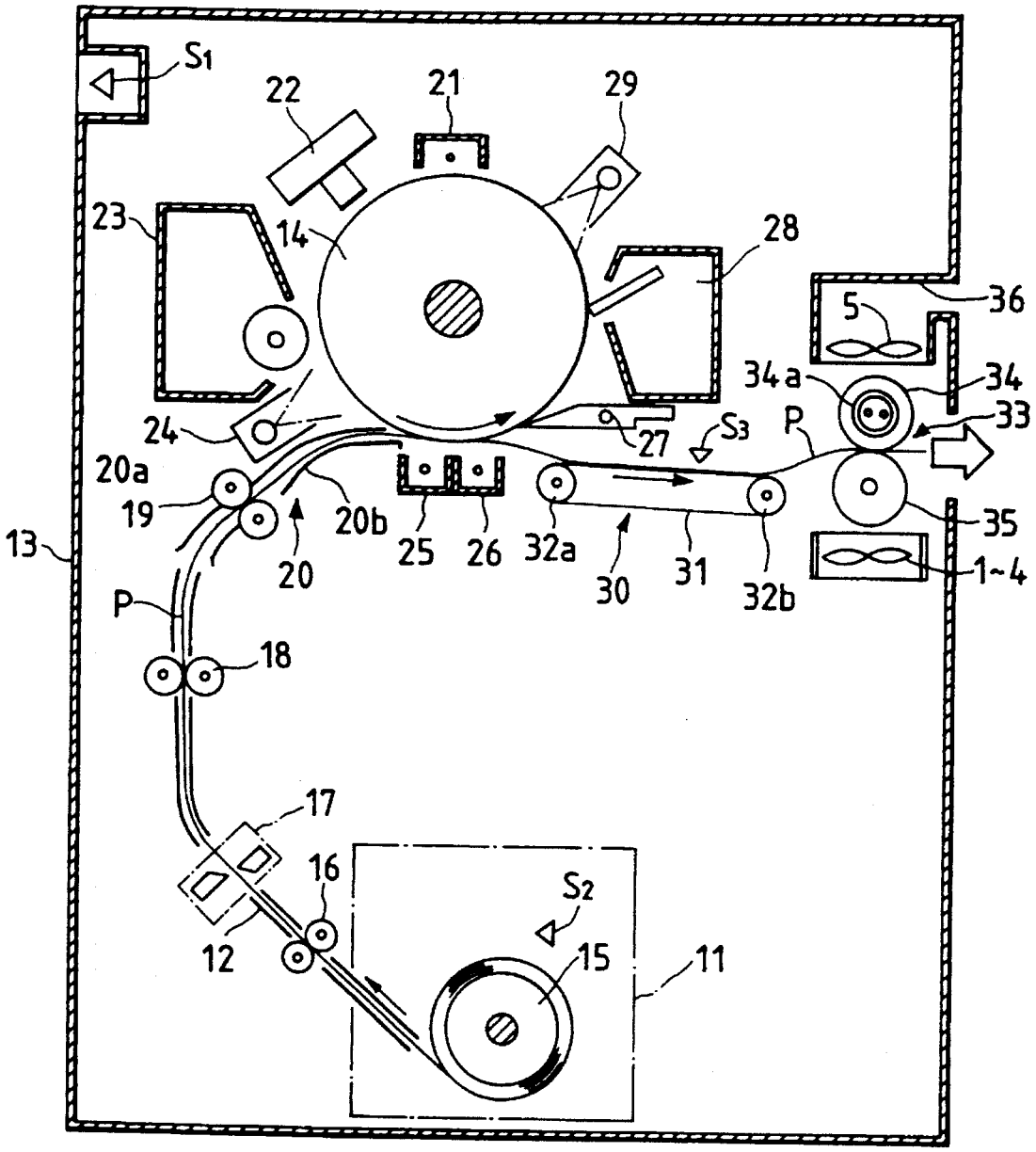
FIG. 1 is a sectional view showing the configuration of an image forming apparatus having a fusing device according to an embodiment of the present invention.

FIG. 1 shows the general configuration of an image forming apparatus including a fusing device according to the embodiment of the invention. As shown in FIG. 1, a transfer sheet P is supplied from a roll paper feeding unit 11, and guided through a transport path 12 toward a photoreceptor drum 14 of the main body 13, where image formation is effected.

A roll of paper 15 is set in the roll paper feeding unit 11. The roll of paper 15 may be of any size to supply a transfer sheet of, for instance, A0-size to A3-size. The size of the roll of paper 15 set in the feeding unit 11 is set in a size setting section 45 (described hereinafter in connection with FIG. 3). Transport rollers 16, a cutter 17, transport rollers 18 and registration rollers 19 are arranged in this order along the transport path 12. With this layout, the paper as unrolled from the feeding unit 11 is transported by the transport rollers 16 to the cutter 17, where it is cut to a specified length. Then, the transfer sheet P is passed through the registration rollers 19 to be delivered to the photoreceptor drum 14 at a specified timing.

A guide section 20 for guiding the transfer sheet P is provided between the registration rollers 19 and the photoreceptor drum 14. The guide section 20 consists of an upper guide plate 20*a* and a lower guide plate 20*b* that are spaced apart by a predetermined distance.

The following devices and units are arranged around the photoreceptor drum 14 in the order written: a charging corotron 21 for building a uniform charge layer on the surface of the photoreceptor drum 14; an exposing head 22 for writing an image to form an electrostatic latent image; a developing unit 23 for developing the electrostatic latent image to form a toner image; an auxiliary charge eliminating unit 24 for reducing the toner adhesion to the photoreceptor drum 14; a transfer corotron 25 for transferring the toner image onto the transfer sheet P; a stripping corotron 26 for stripping the toner image bearing transfer sheet P by electric discharge; a stripping nail 27 for stripping the transfer sheet P mechanically; a cleaning unit 28 for removing residual toner particles from the surface of the photoreceptor drum 14; and a charge eliminating lamp 29 for removing residual charges by electric discharge.

A transport unit 30 is disposed downstream of the photoreceptor drum 14 in so as to guide the toner image bearing transfer sheet P to a fusing unit 33. The transport unit 30 consists of a drive roller 32*a*, a follower roller 32*b* and a transport belt 31 that engages with the two rollers.

The fusing unit 33 consists of a heating roller 34 having a built-in heater 34*a* and a pressure roller 35 that is faced with the heating roller 34 and urged against it at a specified pressure. The transfer sheet P as transported by the transport unit 30 is nipped between the heating roller 34 and the pressure roller 35 and given necessary heat and pressure to have the toner image fused onto the transfer sheet P. The transfer sheet P on which the toner image has been fused is ejected into a receiving tray (not shown).

Figure 2:
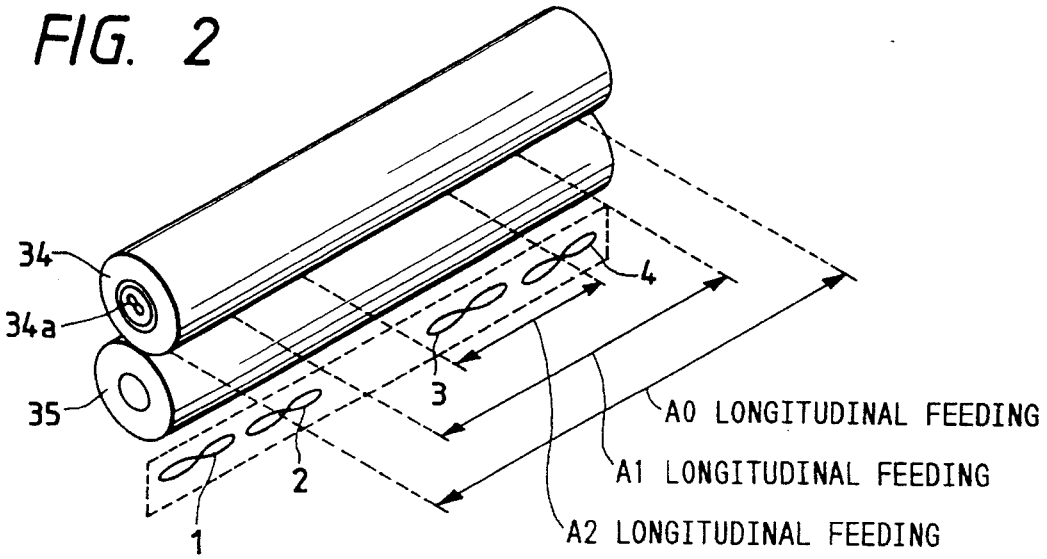
FIG. 2 is a perspective view illustrating the configuration of the fusing device of FIG. 1 and associated cooling sections.

More than one cooling fan say, four cooling fans 1 to 4 are provided under the pressure roller 35. As shown more specifically in FIG. 2, the cooling fans are positioned symmetrically along the axis of the pressure roller 35, namely, in the width direction of the transfer sheet P. The cooling fans 1 to 4 cool the pressure roller 35 that has become hot under the heat from the heating roller 34.

The cooling fans 1 and 4 at the opposite ends are disposed symmetrically in such positions that they face the non-paper-passing portions of the pressure roller 35 when an A1-size transfer sheet P runs with its longer sides being parallel with the transport direction. The middle cooling fans 2 and 3 are disposed symmetrically in such positions that they face the non-paper-passing portions of the pressure roller 35 when an A2-size transfer sheet P runs with its longer sides being parallel to the transport direction. The fusing unit 33 is so constructed that an A0-size transfer sheet P runs so as to cover almost the entire pressure roller 35 in the axial direction. That is, all the cooling fans 1 to 4 face the A0-size transfer sheet P.

Heat removing fans 5 are provided above the heating roller 34 to discharge the air warmed by the heating roller 34 to the outside of the main body 13 via a heat removing path 36.

A temperature sensor $S_1$ for detecting the temperature of the environment in which the image forming apparatus under consideration is installed is provided in the top portion of the main body 13. The temperature sensor $S_1$ may be disposed in any position where it contacts the atmosphere but is not influenced by the hot air being discharged from the fusing unit 33.

Figure 3:
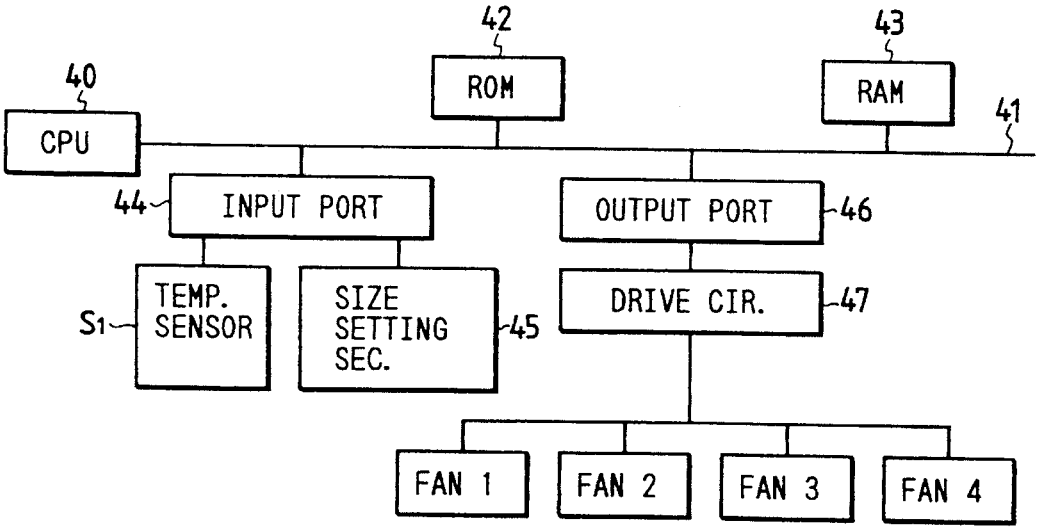
FIG. 3 is a block diagram showing the constitution of a control section of the image forming apparatus of FIG. 1.
Figure 4:
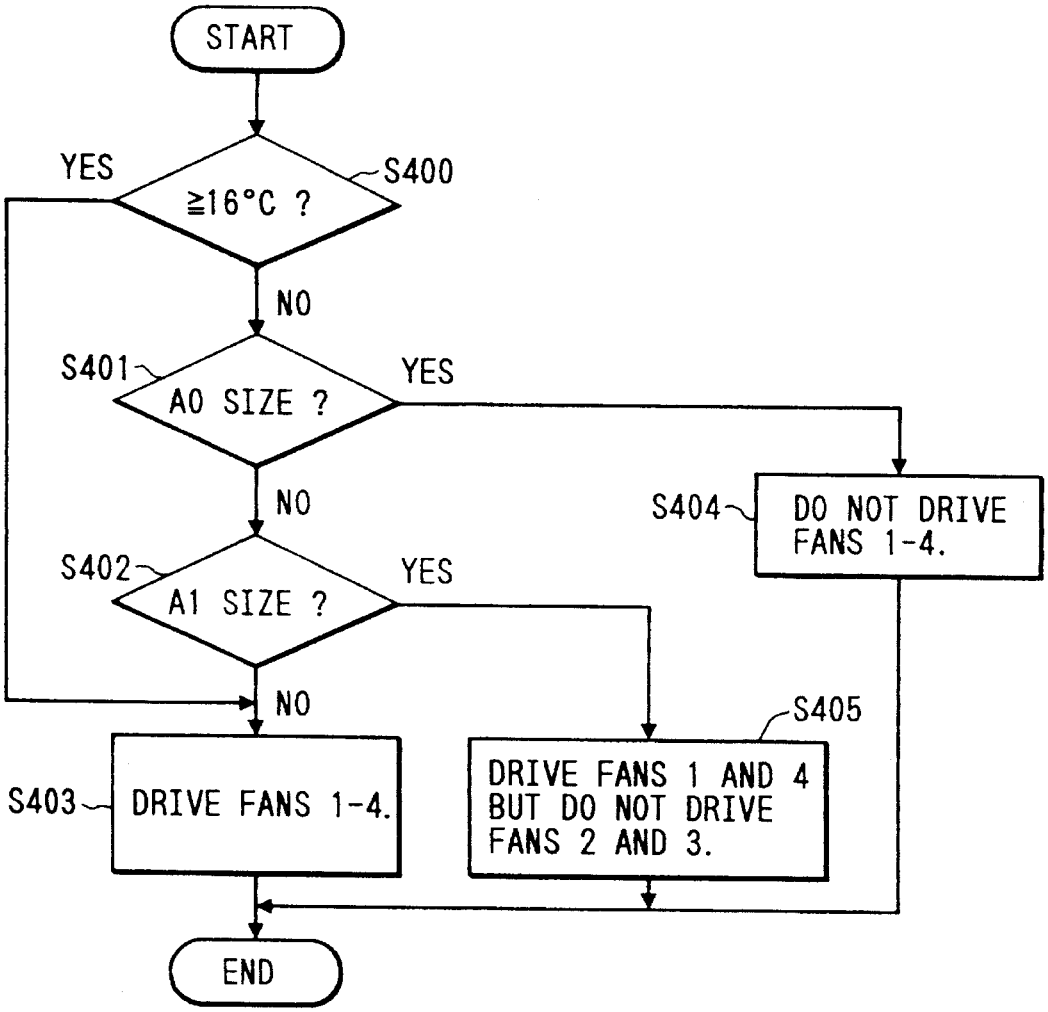
FIG. 4 is a flowchart showing the operation of the image forming apparatus of FIG. 1.

FIG. 3 shows the constitution of a control section of the image forming apparatus under discussion. The control section has a CPU 40, which is connected to the following and other parts of the apparatus via a bus 41. A ROM 42 stores not only a program for controlling the normal copying operation of the apparatus but also a cooling control program that is shown by a flowchart of FIG. 4 (described below). A RAM 43 temporarily stores results of various calculations, various data, etc. An input port 44 is an interface that supplies CPU 40 with a detection signal from the temperature sensor $S_1$ (see FIG. 1) and a size signal as produced from the section 45 for setting the size of the transfer sheet P. The CPU 40 converts the detection signal from the temperature sensor $S_1$ to a value that corresponds to the ambient temperature, compares the conversion result with a value that corresponds to a preset temperature (e.g., 16° C.), and controls the cooling profile of the cooling fans 1 to 4 in accordance with the comparison result and the size of transfer sheet P that has been set in the size setting section 45. An output port 46 is an interface for supplying a drive circuit 47 with a control signal sent from the CPU 40. Receiving the control signal from the CPU 40, the drive circuit 47 selectively drives the cooling fans 1 to 4 in accordance with a specific example shown in Table 1 below.

TABLE 1

| Ambient temperature and size of running transfer sheet | | Action of pressure roller cooling fans | | | |
|---|---|---|---|---|---|
| | | fan 1 | fan 2 | fan 3 | fan 4 |
| ≧16° C. | all sizes | on | on | on | on |
| <16° C. | A0 size | off | off | off | off |
| ↑ | A1 size | on | off | off | on |
| ↑ | A2 size | on | on | on | on |

The operation of the image forming apparatus according to the embodiment will be described below more specifically.

The paper being unrolled from the feeding unit 11 is advanced by the transport rollers 16 by a length that corresponds to the length of a document to be processed. Thereafter, the paper is cut by the cutter 17 and transported by the transport rollers 18. Further, the transfer sheet P is guided by the registration rollers 19 so that it is delivered to the image transfer section located below the photoreceptor drum 14 at a predetermined timing.

The photoreceptor drum 14 rotates counterclockwise (see FIG. 1) at a constant speed. A uniform charge layer is formed on the surface of the photoreceptor drum 14 by means of the charging corotron 21. Then, an image is written by the exposing head 22 to form a latent electrostatic image. The latent electrostatic image is developed (i.e., given toner particles) by the developing unit 23 to become a toner image. The toner image is subjected to electric discharge by the auxiliary charge eliminating unit 24, whereby its adhesion to the photoreceptor drum 14 is reduced. In the image transfer section, the toner image is transferred to the transfer sheet P under the discharging action of the transfer corotron 25. Thereafter, the transfer sheet P is stripped from the photoreceptor drum 14 both by the electric discharge by the stripping corotron 26 and by the mechanical action of the stripping nail 27. The transfer sheet P thus stripped from the photoreceptor drum 14 is guided by the transport unit 30 to pass through the nip portion between the heating roller 34 and the pressure roller 35 which constitute the fusing unit 33, whereby the toner image is fused onto the transfer sheet P. The transfer sheet P is thereafter ejected into the receiving tray (not shown). After the image transfer, residual toner particles on the photoreceptor drum 14 are removed by the cleaning unit 28 and, subsequently, residual charges on the surface of the photoreceptor drum 14 are removed by electric discharge by the charge eliminating lamp 29. These steps constitute the normal copying process.

As already mentioned above, when an A1-size or A2-size transfer sheet P is fed into the fusing unit 33 with its longer sides running parallel with the transport direction, the non-paper-passing portions of the pressure roller 35 are broader than in the case where an A0-size transfer sheet P having the maximum width is fed, and the temperature of those portions becomes higher than the paper-passing portion under the heat of the heating roller 34. As a result, there may occur wrinkles in a sheet and a disorder of a fused image. In order to prevent this problem, in this embodiment, the cooling operation is controlled in the following manner, which is described with reference to FIGS. 1 to 3 and the flowchart of FIG. 4.

To begin with, the CPU 40 checks whether the ambient temperature for the apparatus is equal to or higher than a specified temperature (16° C.) on the basis of the detection signal from the temperature sensor $S_1$ (step S400). If the ambient temperature is equal to or higher than 16° C., the CPU 40 drives all the cooling fans 1 to 4 (step S403), with an assumption that there is a high probability of problems such as the formation of wrinkles in a sheet irrespective of the size of the transfer sheet P. As a result, the cooling profile becomes uniform in the axial direction of the pressure roller 35 to insure that all of the pressure roller 35 including not only the non-paper-passing portions but also the paper-passing portion are cooled.

If the ambient temperature is lower than 16° C. (the judgment in step S400 is No), the CPU 40 controls the action of the cooling fans 1 to 4 in accordance with the size of the transfer sheet P. First, the CPU checks whether the transfer sheet P is of the maximum size A0 (step S401). If the judgment is affirmative, the CPU 40 drives none of the cooling fans 1 to 4 because there is no need to cool the pressure roller 35 (step S404). If the transfer sheet P is not an A0-size sheet (the judgment in step S401 is No), the CPU 40 checks whether the transfer sheet P is an A1-size sheet (step S402). If the judgment is affirmative, the CPU 40 drives the cooling fans 1 and 4 at the opposite ends which face the non-paper-passing portions of the pressure roller 35 and does not drive the middle cooling fans 2 and 3 which are associated with the paper-passing portion of the pressure roller 35 (step S405). If the transfer sheet P is not an A1-size sheet, (the judgment in step S402 is No), the CPU 40 concludes that it is of the minimum size A2, and drives all the cooling fans 1 to 4 so that they cool the pressure roller 35 to provide a uniform cooling profile in the axial direction (step S403).

As described above, the fusing unit 33 according to the embodiment uses the ambient temperature as an operational index. If it is equal to or higher than the specified temperature (16° C.), a substantially uniform cooling profile is provided in the axial direction of the pressure roller 35 irrespective of the size of the transfer sheet P, and not only the non-paper-passing portions of the roller 35 but also the paper-passing portion is cooled. If the ambient temperature is lower than the specified temperature, the cooling profile is changed in accordance with the size of the transfer sheet P so as to cool the non-paper-passing portions primarily.

In this embodiment, since the cooling profile with the cooling fans 1 to 4 is switched in accordance with both of the ambient temperature and the size of the transfer sheet, wrinkles in a sheet and a disorder of a fused image can be prevented even in such an unfavorable situation that the running of a smaller size sheet (e.g., an A1-size sheet with its longer sides being parallel with the transport direction) is immediately followed by the running of a larger size sheet (e.g., an A0-size sheet with its longer sides being parallel with the transport direction).

While the present invention has been described above by way of the preferred embodiment, it should be understood that this is not the sole case of the present invention and that various modifications may be effected without departing from the spirit and scope of the invention. In the embodiment, the ambient temperature as detected by the temperature sensor $S_1$ is used as the sole temperature condition for controlling the cooling operation. If desired, another temperature sensor $S_2$ may be provided near the roll of paper 15 within the roll paper feeding unit 11 as shown in FIG. 1, and the temperature as detected by this sensor $S_2$ may also be taken into account for the control of the cooling operation. By taking into account both temperatures as detected by the two sensors $S_1$ and $S_2$, the cooling operation can be performed more finely than when only the temperature as detected by the sensor $S_1$ is taken into account. If desired, a third temperature sensor $S_3$ may be provided near the transport unit 30 as shown in FIG. 1, so that the temperatures as detected by the sensors $S_1$ to $S_3$ are taken into account in controlling the cooling operation.

The foregoing description of the embodiment assumes that the transfer sheet P to be handled comes in three sizes of A0, A1 and A2 as they run with the longer sides being parallel with the transport direction, and that the four cooling fans 1 to 4 are employed. Of course, the number of transfer sheet sizes and the number of cooling fans are in no way limited to those of the embodiment, and any other numbers may be adopted as appropriate for a specific case.

In the above embodiment, the size of the transfer sheet P is set by an operator who manipulates the size setting section 45. Alternatively, a plurality of sensors may be arranged in the transport path 12 perpendicularly to the transport direction so that the size of the transfer sheet P can be detected automatically by these sensors. Further, the above description of the embodiment assumes that the fusing unit 33 uses a roller on each of the heating and pressure applying sides. It should, however, be noted that either element may be composed of a belt rather than a roller.

The advantages of the present invention are summarized as follows.

At least one of the ambient temperature and the temperature of the transfer paper setting section is taken into account in controlling the action of the cooling means, which enables efficient prevention of wrinkles of a transfer sheet and a disorder of a fused image.

The cooling means is controlled in such a way that the cooling profile in the width direction of the transfer sheet is switched in accordance with the size of the transfer sheet so as to suitable for primarily cooling the portions of the fusing means through which the transfer sheet does not pass. This enables efficient prevention of wrinkles of a transfer sheet and a disorder of a fused image.

At least one of the ambient temperature and the temperature of the transfer paper setting section and the size of the transfer sheet are taken into account in controlling the profile cooling by the cooling means, which enables efficient prevention of wrinkles of a transfer sheet and a disorder of a fused image.

The problem of paper wrinkling due to an uneven temperature increase of the pressure roller is particularly serious in the case where toner images are successively fused onto unrolled paper of a desired length. In accordance with the present invention, the pressure roller is not merely cooled but it is cooled either partly or entirely in accordance with the temperature and the paper size. This is effective in avoiding the formation of wrinkles when a roll of paper is used in the above manner.

What is claimed is:

1. A fusing device comprising:

fusing means for fusing a toner image onto a transfer sheet by applying heat thereto;

cooling means having a plurality of cooling sections arranged in a direction perpendicular to a running direction of the transfer sheet, for cooling the fusing means;

temperature detecting means for detecting at least one of an ambient temperature and a temperature of a section in which transfer paper is set;

comparing means for comparing the temperature detected by the temperature detecting means with a predetermined temperature; and control means for controlling the cooling means so that a cooling profile of the cooling means in a width direction of the transfer sheet becomes substantially uniform if the detected temperature is equal to or higher than the predetermined temperature, and that the cooling profile is switched in accordance with a size of the transfer sheet if the detected temperature is lower than the predetermined temperature.

2. The fusing device according to claim 1, wherein the control means controls the cooling means so that the cooling profile becomes suitable for primarily cooling portions of the fusing means through which the transfer sheet does not pass when the transfer sheet is of a smaller size.

3. A fusing device in a recording apparatus which device successively fuse toner images onto unrolled paper of a desired length while holding the unrolled paper between a heating roller and a pressure roller, said fusing device comprising:

temperature detecting means for detecting at least one of an ambient temperature and a temperature of a section in which roll paper is set;

first cooling means provided so as to cover a region of the pressure roller over which smaller size unrolled paper passes, and second cooling means provided so as to cover a region of the pressure roller over which only larger size unrolled paper passes; and control means for controlling the first and second cooling means in accordance with the temperature detected by the temperature detecting means so that the first and second cooling means are effected when the smaller size unrolled paper passes through the fusing means if the detected temperature is equal to or higher than a predetermined value, and only the second cooling means is effected when the smaller size unrolled paper passes through the fusing means if the detected temperature is lower than the predetermined value.

4. The fusing device according to claim 3, wherein the first and second cooling means are disposed symmetrically with respect to the center of the unrolled paper.

5. The fusing device according to claim 3, wherein the unrolled paper is of an A2 size or larger.

* * * * *